US006317901B1

(12) United States Patent
Corpuel

(10) Patent No.: US 6,317,901 B1
(45) Date of Patent: Nov. 20, 2001

(54) FRESH OR SALT WATER POOL

(76) Inventor: Noel Leon Corpuel, 12 Allevard St., Lido Beach, NY (US) 11561

( * ) Notice: Subject to any disclaimer, the term of this patent is extended or adjusted under 35 U.S.C. 154(b) by 0 days.

(21) Appl. No.: 09/449,583

(22) Filed: Nov. 29, 1999

Related U.S. Application Data

(60) Provisional application No. 60/110,270, filed on Nov. 30, 1998.

(51) Int. Cl.[7] ..... E04H 4/00

(52) U.S. Cl. ..... 4/487; 4/488; 52/169.1; 52/791.1; 405/55

(58) Field of Search ..... 4/487, 488, 494, 4/495, 506, 505; 52/169.1, 169.7, 169.14, 408, 517, 791.1; 405/55

(56) References Cited

U.S. PATENT DOCUMENTS 3,640,073 * 2/1972 Samsel ..... 4/487
4,948,296 * 8/1990 Salter ..... 4/506
4,997,701 * 3/1991 Clem ..... 52/169.14
5,106,229 * 4/1992 Blackwell ..... 4/506
5,346,566 * 9/1994 White ..... 52/169.1
5,489,165 * 2/1996 Smith ..... 52/169.7
5,495,696 * 3/1996 Repka ..... 52/169.14
5,624,204 * 4/1997 Dorsemaine ..... 52/169.14
5,713,696 * 2/1998 Horvath et al. ..... 52/169.14
5,916,104 * 6/1999 Lucenet et al. ..... 52/791.1

* cited by examiner

*Primary Examiner*—Charles R. Eloshway
(74) *Attorney, Agent, or Firm*—Ostrager Chong & Flaherty LLP

(57) ABSTRACT

A swimming pool formed in a natural or man-made body of fresh or salt water includes a flooring material which allows water to pass through, but does not allow dirt or other natural sediment to pass through. The flooring material comprises a layer of stones sandwiched between two layers of geotextile material and a top layer of non-skid vinyl or PVC decking material.

26 Claims, 4 Drawing Sheets

FRESH OR SALT WATER POOL

This application claims benefit to Provisional Application 60/110,270 file Nov. 30, 1998.

FIELD OF INVENTION

This invention relates generally to a swimming pool formed in a natural or man-made body of fresh or salt water. More particularly, it is concerned with a flooring material and method for lining the bottom of a natural or man-made body of water which provides a modified bottom that is comfortable to walk on and does not produce cloudy silty water.

BACKGROUND OF INVENTION

Owners and Directors of children's summer camps, inns and resorts typically chose locations on or near the shores of natural bodies of water, such as lakes, rivers, oceans etc. For purposes of this application, the term "lake" will be used to describe such natural or man-made bodies of water and shall be construed to encompass all types of natural or man-made bodies of water. Typical lakes are filled with either natural spring or ground water, surface water or salt water, have vegetation and other forms of aquatic life and have a lake bottom consisting of sediment, sand, rocks, etc.

Lakes are typically used at children's camps, inns and resorts as the center for all water and recreational activities, including boating, kayaking, sailing and swimming. It has generally been the practice to build docks in the lake to simultaneously provide a boundary for swimmable areas, a place to put slides, diving boards and other recreational swimming apparatus, and to provide a mooring for boats.

Due to the various life forms in the lake, algae and natural sediment or silt form on the lake bottom, causing it to be soft and mucky. During campers's use of the lake, the algae and sediment move around causing the water to appear cloudy. It has been found that campers, when walking and swimming in the lake, do not like the feel of the soft, mucky bottom or the look of the cloudy silty water. The cloudy water also makes it more difficult for lifeguards to observe and supervise swimmers.

Moreover, in recent years, camp owners and directors have been advised that over 50% of all families insist on sending their children to a camp that has a traditional swimming pool, i.e., a man-made pool of chlorinated and filtered water, because their children are used to them from their day-camps. However, traditional public swimming pools have been linked with health related problems and thus require constant pH monitoring and use of expensive filtering equipment and hazardous chemicals.

The present invention resides in the discovery that existing lakes may be modified to form a healthier and environmentally safe alternative to conventional swimming pools which also overcomes the above-described disadvantages of lakes. In the past, several camp owners and others have attempted to use wood and concrete or cement to create a safe and long-lasting bottom for their shallow lake water swim areas. However, the lakes's algae and other natural growth have made these modified lake bottoms slimy and slippery. Further, the wood bottoms cause splinters and the concrete or cement bottoms tend to crack when exposed to cold temperatures, i.e., in the wintertime.

Accordingly, it is a broad object of the invention to provide a modified lake floor which overcomes the problems associated with lakes and conventional swimming pools, and provides a healthier alternative to conventional swimming pools.

A more specific object of the invention is to provide a flooring material and method for installing a flooring material onto the bottom of a lake to provide a swimming area having a comfortable walking surface which resists the accumulation of algae and other natural growth and sediment on the flooring.

SUMMARY OF THE INVENTION

In accordance with the present invention, a swimming pool formed in a lake or any other natural or man-made body of water comprises a flooring material for covering at least a portion of the lake bottom which prevents sediment and sand on the lake bottom from coming through the flooring and is resistant to algea, ultraviolet rays and freezing temperatures. The flooring material or certain layers thereof may also be used to form side walls to prevent sediment from drifting into the pool.

In a preferred embodiment, the flooring material comprises a geotextile filter layer for contacting the bottom of the natural or man-made body of water and a non-skid decking material. The geotextile material has a U.S. Sieve factor of 60–200 and a tensile strength of 120–325 pounds. The decking material is non-buoyant, comprises an impervious material such as vinyl or PVC and an ultra-violet inhibitor, and has a perforated pattern that permits water to flow through the material. In another embodiment, the flooring material further comprises a layer of stones placed between the geotextile material and the bottom of the natural or man-made body of water and a second geotextile layer placed between the layer of stones and the bottom of the natural or man-made body of water. The layer of stones preferably comprises stones having a size ranging from ¼ to ¾ inch.

The invention further relates to a pool formed adjacent to the shoreline of and in a natural or man-made body of water, the shoreline defining at least a first side wall of the pool. The pool comprises a dock extending from a point on the shoreline into the body of water and back to another point on the shoreline to define a swimming area in the body of water, and a flooring material covering the bottom of the natural or man-made body of water corresponding to the swimming area. The flooring material comprises a layer of geotextile material and a layer of non-skid decking material. The geotextile material layers are formed from strips of geotextile material either sewn together with double stitching or overlapped.

The invention also relates to a method for converting a portion of a natural or man-made body of water into a swimming pool, which comprises the steps of forming a first layer of geotextile material and applying it to the bottom of the natural or man-made body of water corresponding to the swimming pool, applying a layer of stones on top of the first layer of geotextile material, raking the layer of stones to fill in any voids in the first layer of the geotextile material caused by the contour of the bottom of the natural or man-made body of water, applying a second layer of geotextile material on top of the layer of stones, forming a layer of non-skid decking material and applying it on top of the second layer of geotextile material, and forming a retaining wall along a shoreline of the natural or man-made body of water and securing the layer of decking material thereto.

Other objects, features and advantages of the present invention will be apparent when the detailed description of the preferred embodiments of the invention are considered in conjunction with the drawings which should be construed in an illustrative and not limiting sense as follows:

DESCRIPTION OF PREFERRED EMBODIMENT

Figure 1:
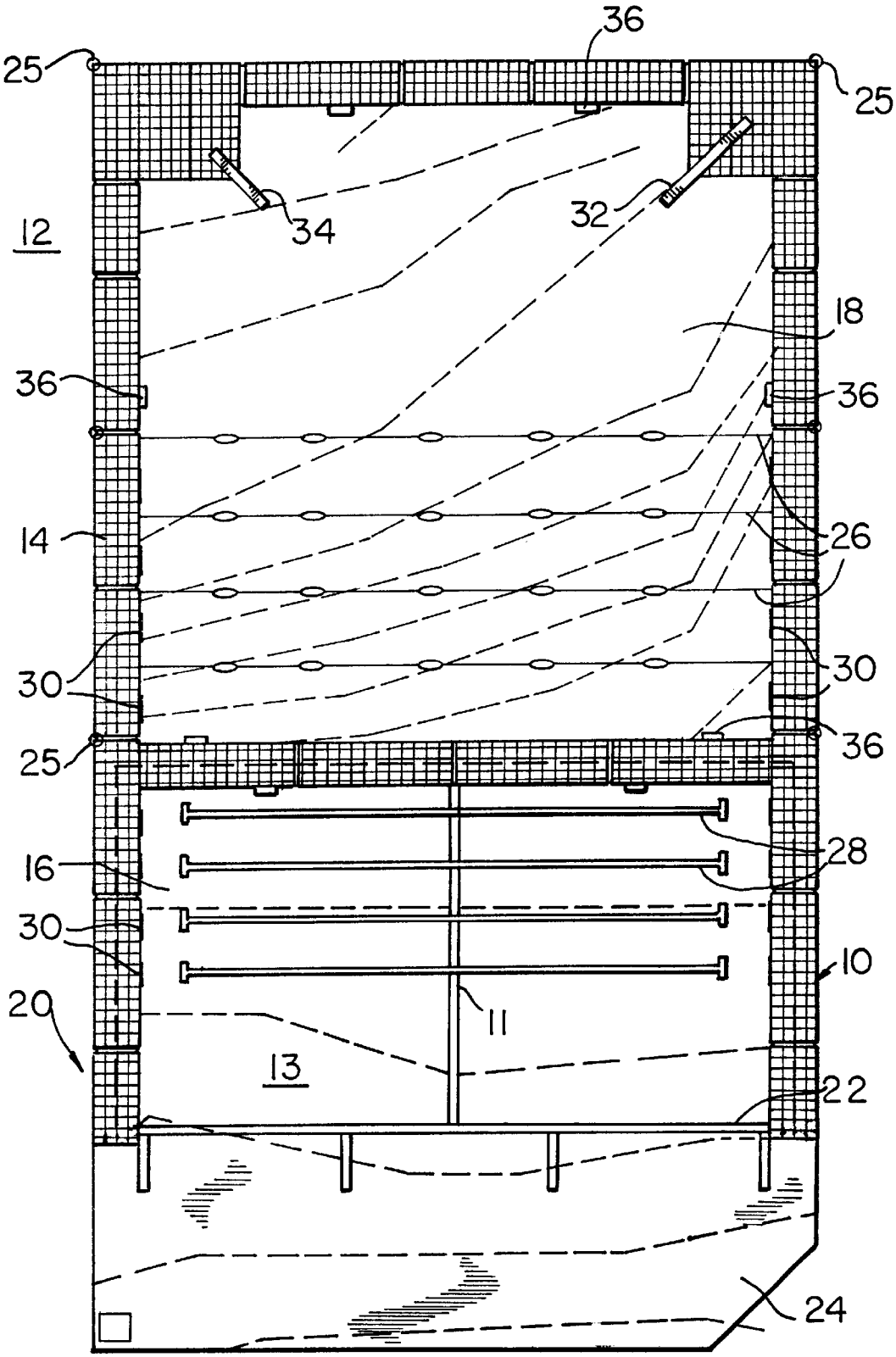
FIG. 1 is a top view of a fresh or salt water pool formed in a lake in accordance with a preferred embodiment of the invention.

FIG. 1 shows a fresh or salt water pool 10 formed in a lake 12 having a modified lake floor 13 in accordance with a preferred embodiment of the invention. A dock 14 comprising a plurality of dock sections defines the pool's boundary and has a divider section 15 for defining a shallow water swimming area 16 and a deep water swimming area 18. The shallow swimming area 16 abuts the lake's shoreline 20 via a bulkhead 22 where sand 24 has been provided to create a beach-like atmosphere. It should be understood, however, that sand is not required. The dock is fixed in place with metal mushroom-type anchors 25 supported in the lake bottom around the periphery of the dock and tied to eyebolts in the bulkhead 22.

Swimming lanes may be provided by buoyed lines 26 or by lane markers 28 in the modified lake floor 13. Turnboards 30 are affixed to the inner sides of the dock and positioned in the swimming lanes. A slide 32 and diving board 34 are placed in the deepest area of the deep water swimming area 18, and step ladders 36 are positioned around the entire deep water swimming area 18. As with any traditional swimming pool, depth markers (not shown) indicating water depth may be painted on the inner edge of the docks at every one foot increment of depth, but no more than 25 feet apart.

The pool may be constructed to be any size by adjusting the width and length of the dock and the lake bottom may be graded to have any desired depth. In the preferred embodiment shown in FIG. 1, the shallow water swimming area 16 is Olympic size, 45 feet by 82 feet. The depth in the shallow swimming area 16 from the bulkhead 22 to the lane markers 28 is gradually graded from 1 foot to 4 feet deep. The depth remains a constant 4 feet in the area where the lane markers are. In the deep water swimming area 18, the lake bottom is graded to gradually increase the depth from 6 feet at the divider section 15 to 25 feet at the outer dock boundary near the diving board 34.

Figure 2:
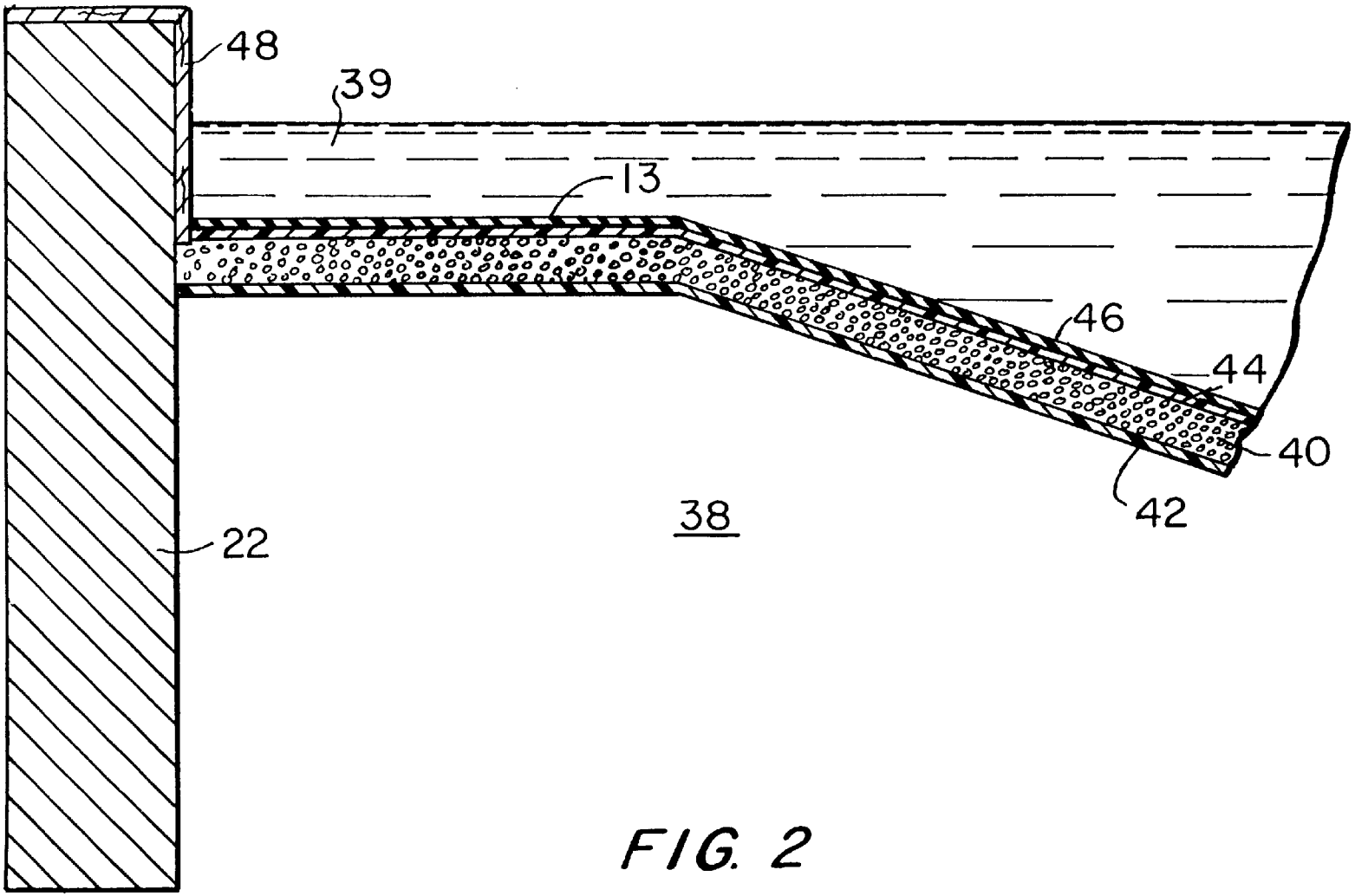
FIG. 2 is an enlarged side view of a fresh or salt water pool showing component layers of the lake bottom in accordance with a preferred embodiment of the invention.

Referring to FIGS. 1 and 2, a preferred construction of the modified lake floor 13 extends from the bulkhead 22 to the dock's divider section 15 to provide a comfortable walking surface in the shallow swimming area 16 which prevents the stirring up of the lake bottom which causes cloudy water. The bulkhead 22 extends approximately 5 feet down into the lake bottom 38 and approximately 6–12 inches above the lake's highest water level 39. The bulkhead is preferably composed of concrete and has a redwood facing 48 on its upper exposed surface and its front and side surfaces extending approximately down to the modified lake floor 13.

The modified lake floor 13 is a multi-layer filter supported on the natural lake bottom which allows water to pass through but does not permit sand, rocks or other sediment on the lake bottom to pass through. The modified lake floor 13 comprises a layer of stones 40 sandwiched between two layers of geotextile fabric 42, 44 and is covered with a layer of vinyl nonskid decking material 46. One layer of geotextile material may also be used by removing the bottom layer 42.

For purposes of this disclosure, the term "geotextile" material shall mean any woven or nonwoven material which is porous enough to permit water to pass through, but dense enough to prevent dirt, silt, sand and other particles from passing through. Such Geotextile materials are typically used in construction projects which require a tough, durable and permeable separator material, for example, beach erosion control, roads and drainage systems.

Geotextile materials for use in the fresh or salt water pool of this invention should have a high tensile strength in the range of 120–325 pounds using ASTM Test Method D4632 and a high US Sieve factor (the rating that describes a fabric's ability to keep particles from passing through) in the range of 60–200 using ASTM Test Method D4751. A preferred geotextile material is commercially available from LINQ Industrial Fabrics, Inc.-Geotextile Division, Summerville, South Carolina under the brand Typar®-3801. This geotextile is a uniform nonwoven fabric thermally spunbonded from polypropylene and has the following specifications:

| | | ASTM Test Method |
|---|---|---|
| Grab Tensile Strength | 325 lbs | D4632 |
| Elongation | 60% | D4632 |
| Trapezoid Tear | 90 lbs | D4533 |
| Puncture | 90 lbs | D4833 |
| Mullen Burst | 250 psi | D3786 |
| Ultra-Violet Stability | 70 | D4355 |
| U.S. Sieve No. | 200 | D4751 |

The Typar®-3801 geotextile is commercially available in rolls of 300 feet, having a width of 187 inches, an area of 519.4 square yards and a weight of 282 pounds. A list of other geotextile manufacturers is available by contacting the Industrial Fabrics Association International.

Because rolls of geotextile material are generally not available in the preferred swimming pool width, several long panels may be sewn together, preferably with double stitching, to create one continuous membrane to be placed on the lake bottom 38. Alternatively, the geotextile material may be laid down in several overlapping pieces. The first layer of geotextile material 42 is placed on the lake bottom 38 and secured thereto with metal, galvanized metal or plastic spikes (not shown). The metal spikes may be inserted into the lake bottom using a heavy (6 pound) sledge hammer under water, or by any other means for inserting a spike into a dense surface.

A layer of sharp crushed stones 40 (washed twice) is placed on top of the first layer of geotextile material 42 and raked to fill in any voids formed in the first layer of geotextile material caused by the contour of the lake bottom. The stone layer therefore serves to keep the first layer of geotextile material 42 down and to provide a uniform base for application of the second layer of geotextile material 44. The stone layer is preferably 2–4 inches thick and weighs approximately 50 tons. Preferred stones should have a pointed or sharp shape and have a size ranging from ¼–¾ inch, for ease of raking and compactability, although other sizes may be used depending on the surface contour of the lake bottom.

The second layer of geotextile material 44 is applied on top of the stone layer 40 to act as a second filter. It may be applied in similar fashion to the first layer, or may be applied in smaller overlapping sections. The second layer is secured to the lake bottom with metal, galvanized metal or plastic spikes arranged approximately every four feet throughout the entire pool to prevent movement of the geotextile layers 42, 44 and the stone layer 40.

A top layer of non-skid decking material 46 made from vinyl or PVC is placed on top of the second geotextile layer 44 to provide a smooth, but safe, floor to walk on. Preferred materials for use as the top layer 46 should be non-buoyant, capable of allowing water to pass through, should be able to withstand freezing temperatures (without curling or cracking) and should have a non-skid, but otherwise comfortable surface. It is also preferable that the top layer be fungus and mildew resistant and have ultra-violet inhibitors or stabilizers.

Examples of preferred top layer materials are, but not limited to, the SAFETY SLIP™ decking material manufactured by JCH International & RCM International, the DRI-DECK™ decking material manufactured by Kendall Products, the MATEFLEX II™, MATEFLEX III™ and VERSAFLEX™ decking materials manufactured by Mateflex Corporation, the ENVIROTILES™ manufactured by North West Rubber Mats Ltd. and the SHOWER TILES™ material manufactured by RB Rubber Products. These materials are all available in interlocking modular squares and therefore must have high tensile strength when snapped together to withstand the weight of swimmers and any natural current in the lake's water.

For ease of installation, rows of modular squares (2 feet by 87 feet) were formed outside of the water and each joint between the squares was fused with PVC cement. Any other adhesive which can fuse vinyl or PVC and withstand water and freezing temperatures may be used. Each row was then placed on top of the second geotextile layer 44 and snapped to the previously installed row. To prevent movement, the top layer 46 is secured to the lake bottom 38 around its perimeter (under the docks 14, 15 and at the base of the bulkhead 22) with 8 inch staples and 15 inch stakes both coated with a rust preventative primer and paint. The modular squares may be arranged in any color pattern. In FIG. 1, the squares in the floor 13 were arranged to make four swimming or racing lanes of black tiles with a "T" at each end so swimmers know when to prepare for doing turns to change direction. A half way line of white tile 11 was installed for recreational purposes.

The modified lake floor 13 was installed on lake bottom 38 corresponding to the shallow swimming area 16. The three dock sections surrounding the shallow swimming area 16 act as three walls of the pool of this invention. A jetty of stone filled cement blocks was placed under each of the two dock sections adjacent to the bulkhead 22 extending up from the natural lake floor 38 to prevent sediment from drifting into the pool area. The stone jetty (not shown) may be covered with geotextile material.

Figure 3:
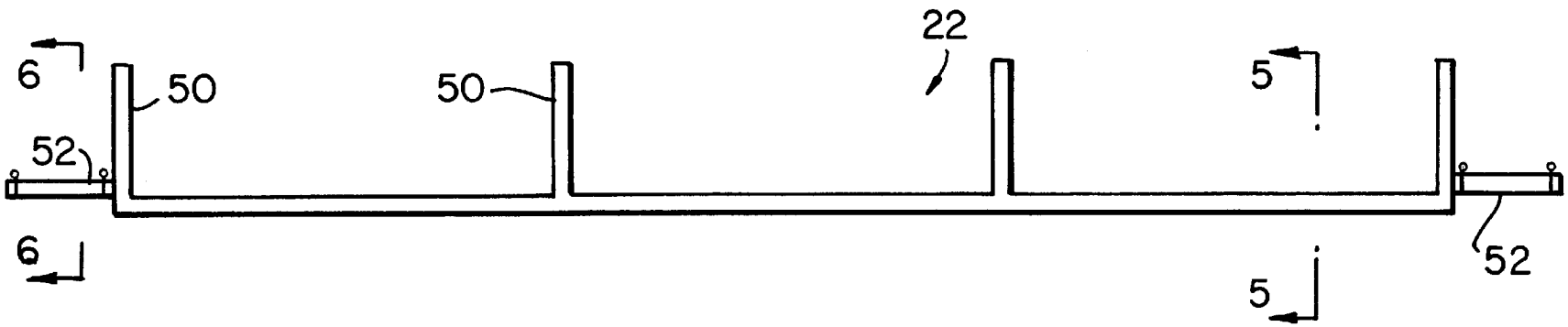
FIG. 3 is a top view of a bulkhead for a fresh or salt water pool in accordance with a preferred embodiment of the invention.

To create a more traditional pool look and feel, a fourth wall or bulkhead 22 was created on the lake shoreline. The bulkhead also serves as a retaining wall and a support for the dock 14. Referring to FIGS. 1 and 3, a preferred bulkhead 22 extends the entire width of the shallow swimming area 16 and comprises four perpendicular, spaced apart buttress supports 50 and two dock supports 52. The buttress supports are buried in the sand, grass or dirt shoreline 24 and should extend approximately 8 feet to support the bulkhead 22. All sections of the bulkhead 22 should be approximately 1 foot thick and 5 feet high, such that when buried, the bottom of the bulkhead extends to a depth below the frost level at the shoreline and the top is approximately 6–12 inches above the highest water level 39 (see FIG. 2).

Figure 4:
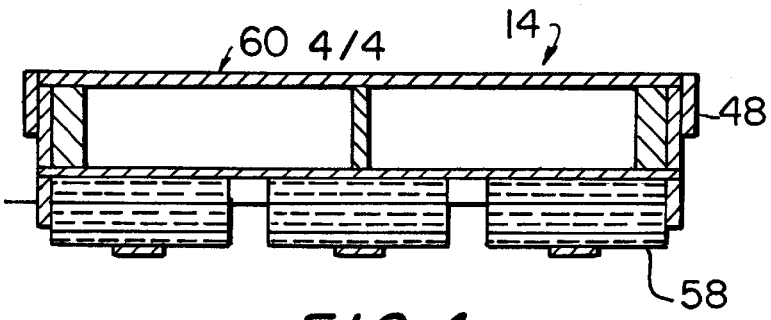
FIG. 4 is a cross-sectional view of a floating dock for use with a fresh or salt water pool in accordance with a preferred embodiment of the invention.
Figure 5:
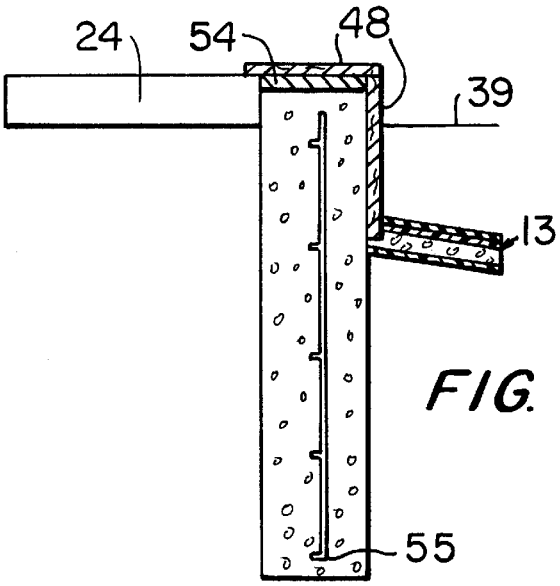
FIG. 5 is a cross-sectional side view of the bulkhead shown in FIG. 3 taken along the line 5—5.
Figure 6:
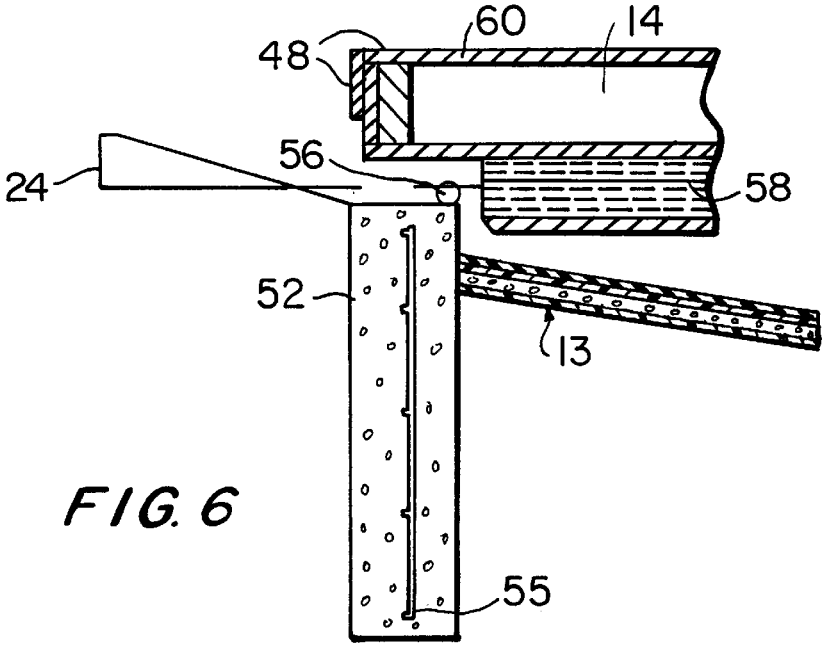
FIG. 6 is a cross-sectional side view of a wing wall portion of the bulkhead shown in FIG. 3 taken along the line 6—6 showing its position relative to the floating dock.

As shown in FIGS. 5 and 6, the bulkhead 22 is preferably constructed with pressure treated nailers 54 tapered and embedded in concrete and #3 rebar 55. Each exposed area of the bulkhead was covered with redwood 48 so that it blends in with the docks 14. The dock supports 52 are further provided with two continuous weld eyebolts 56 embedded in the concrete to provide a place to tie up the dock 14. The dock may be any type of dock. The dock shown in FIG. 4 is a typical floating dock having a wood frame supported by three rows of styrofoam buoyancy billets 58, topped with a vinyl or PVC non-skid decking material 60 for its walking surface and faced with redwood 48 on its sides.

The pool 10 may also be constructed without a bulkhead 22. If the pool is being constructed in a body of water that has a sand beach, the top layer 46 of tiles may be buried and stapled directly into the shoreline. If there is a sand, grass or dirt shoreline which is not perfectly straight or smooth, then landscape ties could be set at the shoreline for the top layer 46 to butt up against and be attached to. The landscape ties could be redwood or other wood.

The pool 10 may also be constructed on lakes which have preexisting fabricated bottoms (such as cement, wood or concrete). For this application, one layer of geotextile material and one layer of modular interlocking vinyl or PVC decking material is sufficient.

During the winter, to prevent ice damage to the bulkhead and an iceberg effect from moving the modified lake floor 13, it is recommended that bubblers or agitators be installed to prevent the water from freezing.

Although the invention has been described with reference to preferred embodiments, it will be appreciated by one of ordinary skill in the art that numerous modifications are possible in light of the above disclosure. For example, the size and depth of the pool, the type of geotextile or other filter fabric used, the type of vinyl or PVC flooring material, the number of layers of geotextile and/or stones, the size and shape of the stones, the method of weighting down, securing and stabilizing the floor, the type of shoreline, existing lake bottom and/or bulkhead are all factors which may be modified without varying from the scope of this invention. All such variations and modifications are intended to be within the scope and spirit of the invention, as defined in the claims appended hereto.

I claim:

1. A floor for covering a bottom of a natural or man-made body of water to provide a smooth and comfortable walking surface and to prevent production of cloudy water, comprising a geotextile filter layer and a non-skid decking material, wherein the floor allows water to pass through but does not allow dirt or other natural sediment to pass through.

2. The floor according to claim 1, wherein the geotextile filter layer has a U.S. Sieve factor of 60–200 and a tensile strength of 120–325 pounds.

3. The floor according to claim 2, wherein the decking material is non-buoyant and comprises vinyl or PVC and an ultra-violet inhibitor.

4. The floor according to claim 1, further comprising a layer of stones placed between the geotextile material and the bottom of the body of water.

5. The floor according to claim 4, further comprising a second geotextile layer placed between the layer of stones and the bottom of the body of water.

6. The floor according to claim 4, wherein the layer of stones comprises stones having a size ranging from ¼ to ¾ inch.

7. The floor according to claim 6, wherein the stones have a pointed or sharp shape.

8. The floor according to claim 1, wherein the decking material has openings that allow water to pass through.

9. A pool formed adjacent to a shoreline of and in a natural or man-made body of water having a bottom, the shoreline defining at least a first side wall of the pool, the pool comprising a flooring material covering the bottom of the body of water corresponding to the pool, the flooring material comprising a layer of geotextile material and a layer of non-skid decking material, wherein the flooring material allows water to pass through but does not allow dirt or other natural sediment to pass through.

10. The pool according to claim 9, wherein the geotextile material has a U.S. Sieve factor of 60–200 and a tensile strength of 120–325 pounds and the decking material is non-buoyant and comprises vinyl or PVC and an ultra-violet inhibitor.

11. The pool according to claim 9, further comprising a layer of stones placed between the layer of geotextile material and the bottom of the body of water.

12. The pool according to claim 11, further comprising a second layer of geotextile material placed between the layer of stones and the bottom of the body of water.

13. The pool according to claim 11, wherein the layer of stones comprises stones having a size ranging from ¼ to ¾ inch.

14. The pool according to claim 13, wherein the stones have a pointed or sharp shape.

15. The pool according to claim 9, further comprising a dock extending from a point on the shoreline into the body of water and back to another point on the shoreline to define a swimming area in the body of water.

16. The pool according to claim 9, wherein the decking material has openings that allow water to pass through.

17. The pool according to claim 9, further comprising a retaining wall formed along the shoreline.

18. A method for converting a portion of a natural or man-made body of water into a swimming pool, which comprises:

(a) forming a layer of geotextile material and applying it to the bottom of the body of water corresponding to the swimming pool; and (b) forming a layer of non-skid decking material and applying it on top of the layer of geotextile material, such that the geotextile material and the decking material allow water to pass through but do not allow dirt or other natural sediment to pass through.

19. The method of claim 18, wherein the geotextile material has a U.S. Sieve factor of 60–200 and a tensile strength of 120–325 pounds and the decking material is non-buoyant and comprises vinyl or PVC and an ultra-violet inhibitor.

20. The method of claim 18, wherein the layer of geotextile material is formed from strips of geotextile material sewn together with double stitching.

21. The method of claim 18, wherein the layer of geotextile material is formed from a plurality of strips of geotextile material placed in overlapping relationship on the bottom of the body of water.

22. The method of claim 18, further comprising the step of securing the layer of geotextile material to the bottom of the body of water with a plurality of spikes.

23. The method of claim 18, further comprising the steps of forming a retaining wall along a shoreline of the body of water.

24. A method for converting at least a portion of a natural or man-made body of water into a swimming pool, which comprises:

(a) applying a layer of stones to the bottom of the body of water corresponding to the swimming pool;

(b) forming a layer of geotextile material and applying it on top of the layer of stones; and (c) forming a layer of non-skid decking material and applying it on top of the layer of geotextile material, such that the layer of stones, the geotextile material and the decking material allow water to pass through but do not allow dirt or other natural sediment to pass through.

25. The method of claim 24, further comprising the step of raking the layer of stones to fill in any voids in the layer of geotextile material caused by the contour of the bottom of the body of water.

26. A method for converting at least a portion of a natural or man-made body of water into a swimming pool, which comprises:

(a) forming a layer of geotextile material and applying it to the bottom of the body of water corresponding to the swimming pool;

(b) applying a layer of stones on top of the layer of geotextile material;

(c) forming a second layer of geotextile material and applying it on top of the layer of stones; and (d) forming a layer of non-skid decking material and applying it on top of the second layer of geotextile material.

* * * * *